United States Patent [19]

Asanomi et al.

[11] Patent Number: 4,615,308

[45] Date of Patent: Oct. 7, 1986

[54] AUXILIARY MECHANISM DRIVING DEVICE IN A V-TYPE ENGINE

[75] Inventors: Koji Asanomi; Haruyoshi Ishimi, both of Hiroshima, Japan

[73] Assignee: Mazda Motor Corporation, Hiroshima, Japan

[21] Appl. No.: 586,562

[22] Filed: Mar. 6, 1984

[30] Foreign Application Priority Data

Mar. 11, 1983 [JP] Japan ..... 58-41165
Apr. 18, 1983 [JP] Japan ..... 58-68790

[51] Int. Cl.[4] ..... F01L 1/02; F02F 7/00

[52] U.S. Cl. ..... 123/90.27; 123/52 MV; 123/195 A; 123/198 C

[58] Field of Search ..... 123/195 R, 195 A, 90.27, 123/90.31, 198 C, 52 MV

[56] References Cited

U.S. PATENT DOCUMENTS

| | | | |
|---|---|---|---|
| 1,631,185 | 6/1927 | Anibal | 123/195 A |
| 2,660,987 | 12/1953 | Doughty | 123/195 A |
| 3,306,271 | 2/1967 | Turlay | 123/90.27 |
| 3,888,217 | 6/1975 | Hisserich | 123/90.31 |
| 4,054,108 | 10/1977 | Gill | 123/198 C |
| 4,129,043 | 12/1978 | Ishikawa | 123/195 A |
| 4,480,600 | 11/1984 | Gill | 123/52 MV |

FOREIGN PATENT DOCUMENTS 114845 9/1980 Japan .

OTHER PUBLICATIONS

MZT Motor Tech., Journal #38; Jul. 1977; pp. 290, 294 & 297.

Dr. Kosh; Special Part Motorcycle Techniques: "Toothed Belt as Drive for Camshafts"; Motorcycle #20; Jan. 1978; first page of article.

Motor, Jun. 17, 1978, p. 29.

Allard; Turbocharging & Supercharging; Jan. 1982; pp. 116–118.

*Primary Examiner*—Craig R. Feinberg

*Attorney, Agent, or Firm*—Gerald J. Ferguson, Jr.; Michael P. Hoffman; James E. Bryan

[57] ABSTRACT

An improved, compact auxiliary mechanism driving device in a V-type, overhead-camshaft engine in which a driving section for engine auxiliary mechanism is mounted on a camshaft without increasing the overall size of the engine by utilizing a vacant or unused space(s) on the camshafts peculiar to such an overhead-camshaft engine. A pair of first and second cylinder banks are arranged in V-shape and have a first and a second cylinder head, respectively. The cylinders of the first bank are displaced from the cylinders of the second bank in the axial direction of the camshaft. A first camshaft having first valve-operating cams for the first cylinders is provided on the first cylinder head of the first cylinders. A second camshaft having second valve-operating cams for the second cylinders is provided on the second cylinder head of the second cylinders. The first and second camshafts are operatively connected at their one end with the associated end of the crankshaft for synchronized rotation therewith through a transmission mechanism. The first cams on the first camshaft are displaced from the second cams on the second camshaft in a manner such that the former are disposed axially more apart from the transmission mechanism than the latter. The engine auxiliary mechanism is driven by means of the first camshaft and has a drive section mounted on the first camshaft at a location between the transmission mechanism and the one of the first cams on the first camshaft nearest to the transmission mechanism.

11 Claims, 11 Drawing Figures

AUXILIARY MECHANISM DRIVING DEVICE IN A V-TYPE ENGINE

BACKGROUND OF THE INVENTION

1. Field of the Invention

This invention relates to an auxiliary mechanism driving device in a V-type engine, and more specifically, to a device for driving auxiliary mechanism in a V-type engine having overhead camshafts.

2. Description of the Prior Art

In the past, there has been known a V-type engine which has engine auxiliary mechanism adapted to be driven to rotate by means of the engine crankshaft, the auxiliary mechanism being disposed in the V-shaped space defined between the pair of banks of engine cylinders. Also, as shown in Japanese Unexamined Patent Publication No. 55(1980)-114845, one of a pair of V-arranged banks is displaced in the axial direction of the crankshaft with respect to the other so as to provide a space at a location axially ahead of the one bank and another space at a location axially behind the other bank, so that auxiliary mechanisms for the engine to be driven by the crankshaft are separately disposed in these spaces, thus reducing the overall shape and size of the engine.

With such V-type engines as referred to above, however, in order to provide a driving section for one or more auxiliary mechanisms, it is required to extend the crankshaft and the camshaft in the forward and rearward directions of the engine. This results in an increase in the overall length of the engine, thus involving a disadvantage that the overall shape and size of the engine are not minimized to any substantial extent.

SUMMARY OF THE INVENTION

The present invention is intended to obviate the above-described disadvantages encountered in the prior art arrangements.

The primary object of the present invention is to provide an improved auxiliary mechanism driving device in a V-type engine having overhead camshafts in which a driving section for auxiliary mechanisms is provided without increasing the overall size of the engine by utilizing a vacant or unused space(s) or portion(s) on the camshafts peculiar to such an overhead-camshaft engine.

In order to achieve the above objects, according to one aspect of the present invention, there is provided an engine auxiliary mechanism driving device in a V-type engine which comprises:

an engine crankshaft;

a pair of first and second cylinder banks arranged in a V-shape, the first and second banks including a first group of cylinders with a first cylinder head and a second group of cylinders with a second cylinder head, the first group of cylinders being displaced from the second group of cylinders in the axial direction of the crankshaft;

a first camshaft provided on the first cylinder head and having a plurality of first valve-operating cams for the first cylinders;

a second camshaft provided on the second cylinder head and having a plurality of second valve-operating cams for the second cylinders;

the first and second camshafts being operatively connected at their one end with the associated end of the crankshaft for synchronized rotation therewith through a transmission means;

the first cams on the first camshaft being displaced axially from the second cams on the second camshaft in a manner such that the former are disposed axially more apart from the transmission means than the latter; and an engine auxiliary mechanism adapted to be driven by means of the first camshaft and having a drive section mounted on the first camshaft at a location between the transmission means and the one of the first cams on the first camshaft nearest to the transmission means.

According to another aspect of the present invention, there is provided an engine auxiliary mechanism driving device in a V-type engine which comprises:

an engine crankshaft;

a pair of first and second cylinder banks arranged in a V-shape, the first and second banks including a first group of cylinders with a first cylinder head and a second group of cylinders with a second cylinder head, the first group of cylinders being displaced from the second group of cylinders in the axial direction of the crankshaft;

a first camshaft provided on the first cylinder head and having a plurality of first valve-operating cams for the first cylinders;

a second camshaft provided on the second cylinder head and having a plurality of second valve-operating cams for the second cylinders;

the first and second camshafts being operatively connected at their one end with the associated end of the crankshaft for synchronized rotation therewith through a transmission means;

the first cams on the first camshaft being displaced axially from the second cams on the second camshaft in a manner such that the former are disposed axially more apart from the transmission means than the latter; and a crankcase at the lower side of the cylinder banks; and an oil pump in the crankcase as an auxiliary mechanism adapted to be driven by means of the first camshaft and having a rotation shaft operatively connected with the first camshaft through the intermediary of a driving means;

the driving means comprising a worm gear fixedly mounted on the first camshaft at a location between the transmission means and the one of the first cams on the first camshaft nearest to the transmission means, a worm wheel in meshing engagement with the worm gear, and a drive shaft coupled at its one end with the worm wheel and at its other end with the rotation shaft of the oil pump, the drive shaft being disposed in and extending through the dead space of the first cylinder bank formed at the one end thereof adjacent to the transmission means.

The above and other objects, features and advantages of the present invention will become apparent from the following detailed description of several preferred embodiments when taken in conjunction with the accompanying drawings.

BRIEF DESCRIPTION OF THE DRAWINGS

FIGS. 1 to 3 show an engine auxiliary mechanism driving device in a V-type engine according to a first embodiment of the present invention, in which: FIG. 1 is a schematic front view; FIG. 2 is a plan view; and FIG. 3 is a partially cutaway side view, FIGS. 6 to 11 show a fourth embodiment of the present invention, in which: FIG. 6 is a schematic front view; FIG. 7 is a plan view; FIG. 8 is a partially cutaway side view; FIG. 9 is a partially cutaway front view, on a somewhat enlarged scale, showing the essential parts of a first engine auxiliary mechanism; FIG. 10 is a partially cutaway front view, on a somewhat enlarged scale, showing the essential parts of a second engine auxiliary mechanism; and FIG. 11 is a partially cutaway side view showing the second engine auxiliary mechanism.

DESCRIPTION OF THE PREFERRED EMBODIMENTS

In the accompanying drawings and the following description, the same or corresponding parts or elements are identified with like references throughout several embodiments.

Figure 1:
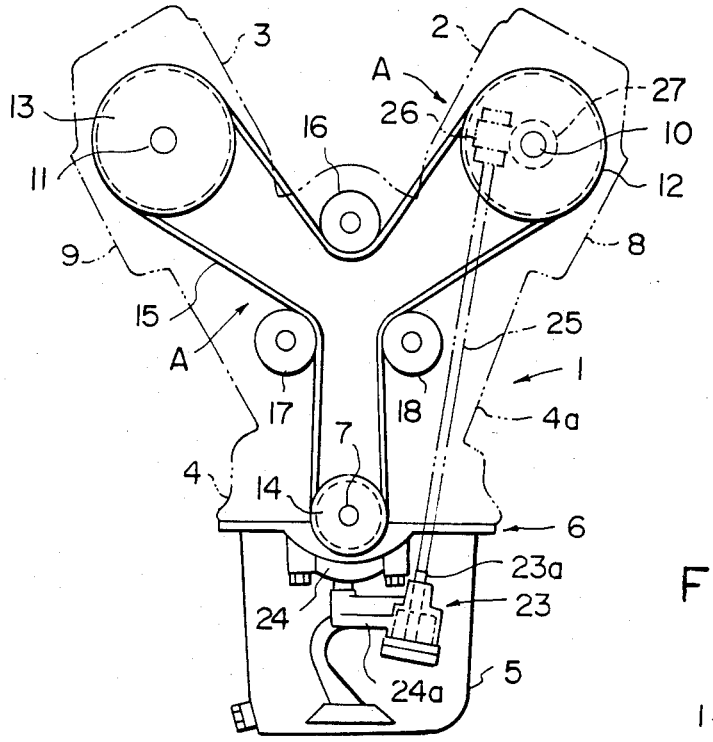
Figure 11:
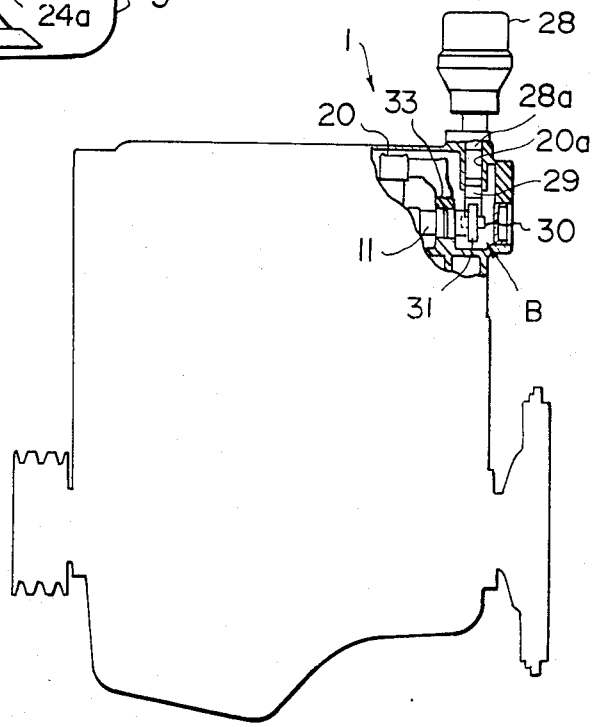
Figure 2:
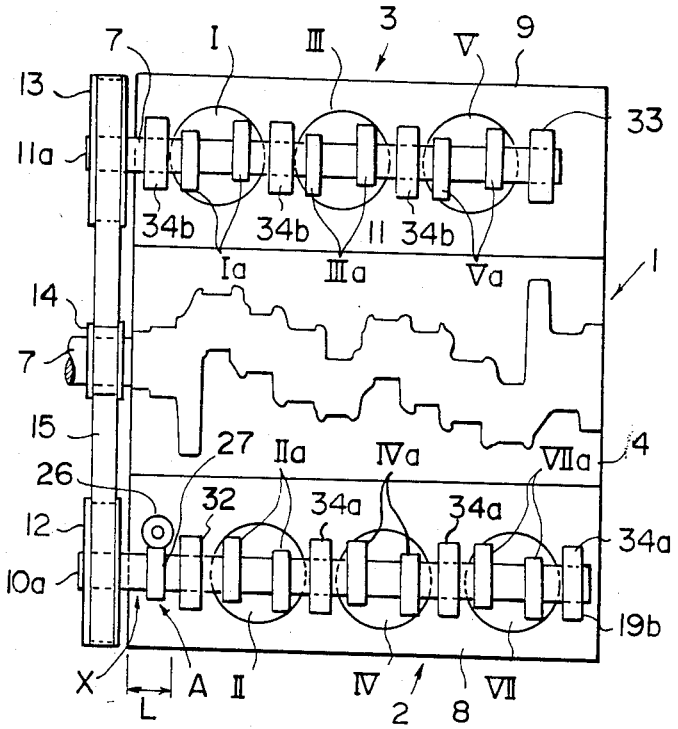
Figure 3:
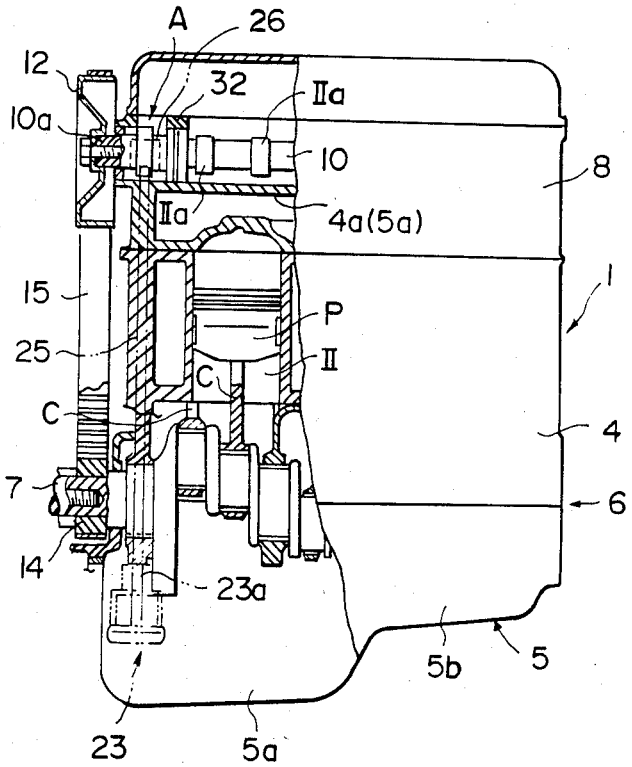

Referring to the drawings and first to FIGS. 1 to 3, there is shown a V-type, overhead-camshaft engine, generally designated by reference numeral 1, which is provided with an engine auxiliary mechanism driving device embodying the present invention. The V-type engine 1 includes a cylinder block 4 having a first cylinder bank 2 and a second cylinder bank 3 arranged in a V-shape. Secured to the bottom surface of the cylinder block 4 is an oil pan 5 which forms, together with the lower part of the cylinder block 4, a crankcase 6 in which is disposed a crankshaft 7.

Mounted on the top surfaces of the first and second banks 2, 3 of the cylinder block 4 in an air-tight manner are a first cylinder head 8 in which a first camshaft 10 is rotatably supported by means of bearings 32, 34*a* . . . , and a second cylinder head 9 in which is rotatably supported a second camshaft 11 by means of bearings 33, 34*b* . . . . The camshafts 10, 11 are operatively connected at their front ends 10*a*, 11*a* (the left-hand ends in FIGS. 2 and 3) with the crankshaft 7 through a transmission means so that they are driven to rotate in synchronism with the rotation of the crankshaft 7. The transmission means comprises timing pulleys 12, 13 respectively fixedly mounted on the front ends 10*a*, 11*a* of the camshafts 10, 11, a crank pulley 14 fixed on the front end of the crankshaft 7, and a timing belt 15 entrained around the pulleys 12, 13 and 14. Also, illustrated in FIG. 1 are idlers 16, 17 and 18 for the timing belt 15.

In this connection, it is to be noted that though not shown in the drawings, the transmission means may be a chain-and-sprocket transmission in place of the belt-and-pulley transmission as illustrated. Specifically, the timing pulleys 12, 13, the crankshaft pulley 14 and the timing belt 15 may be replaced by two timing sprockets, a crankshaft sprocket and a timing chain, respectively.

In the first cylinder bank 2 of the cylinder block 4 there are formed three cylinders assigned even numbers II, IV and VI as numbered from the front to the back (the left side to the right side in FIG. 2), whereas in the second cylinder bank 3 there are formed three cylinders assigned odd numbers I, III and V as numbered similarly. These cylinders I–VI slidably receive respective pistons P which are connected with the crankshaft 7 in this order from its front end to its back end through respective connecting rods C. Thus, the cylinders I–VI are arranged in a manner such that every one of the cylinders (except cylinders I and VI) of one bank lies between the two adjacent cylinders of the other bank in the axial direction of the crankshaft 7, that is, the cylinders II, IV and VI of the first bank 2 are displaced axially from the cylinders I, III and VI of the second bank 3 such that the former are spaced more apart from the front end of the cylinder block 4 than the latter. Despite such an arrangement of the cylinders I–VI, the cylinder banks 2, 3 and the cylinder heads 8, 9 are respectively formed such that the front portion of one bank or head has basically the same construction as that of the rear portion of the other bank or head. In other words, the front portions of the bank 3 and the cylinder head 9 are the same in construction as the back portions of the bank 2 and the cylinder head 8, respectively. The first camshaft 10 has three pairs of valve-operating cams IIa, IVa and VIa corresponding to the cylinders II, IV and VI, respectively and the second camshaft 11 has three pairs of valve-operating cams Ia, IIIa and Va corresponding to the cylinders I, III and V, respectively.

In FIGS. 1 and 3, reference numeral 33 represents an engine auxiliary mechanism namely an oil pump which is mounted on a bearing cap 24 for the crankshaft 7 by means of a bracket 24*a*. The oil pump 23 is disposed in a deep or downwardly projected portion 5*a* of the oil pan 5 at the front side thereof. The oil pump 23 is operatively connected with the first camshaft 10 in the first cylinder head 8 through a driving means A. The driving means A comprises a worm gear 27 fixedly mounted on the first camshaft 10, a worm wheel 26 in meshing engagement with the worm gear 27, and a drive shaft 25 firmly mounting at its one end the worm wheel 26 and operatively coupled at its other end with a rotation shaft 23*a* of the oil pump 23. In this connection, it is to be noted that as viewed in FIG. 2, the worm gear 27, constituting a drive section for driving the engine auxiliary mechanism (oil pump) 23, is disposed on the first camshaft 10 at its front end or at a location X midway of the distance L between the timing pulley 12 (which connects the first camshaft 10 with the crankshaft 7) and the camshaft bearing 32 adjacent or nearest thereto. The drive shaft 25 vertically extends through and is rotatably supported by the cylinder block 4 at a location between the front end face thereof and the frontmost cylinder II of the first bank 2, as clearly observed in FIG. 3.

With the above arrangement, the worm gear 27, constituting the drive section for driving the engine auxiliary mechanism (oil pump) 23, is disposed at a vacant space or location which is unavoidably formed between the timing pulley 12 (which connects the first camshaft 10 with the crankshaft 7) and the nearest camshaft bearing 32 by arranging the crank pulley 14 and the timing pulleys 12, 13 on the one and the same plane. For this reason, it is not necessary to enlarge the axial dimension of the cylinder block 4, and hence of the entire engine 1, for the purpose of forming the drive section A of the engine auxiliary mechanism (oil pump) 23.

Also, the drive shaft 25 is arranged such that it extends through the dead space of the cylinder block 4 at the side of the first bank 2 which is necessarily formed by displacing the cylinders II, IV and VI of the first bank 2 relative to the cylinders I, III and V of the second bank 3 in the axial direction of the crankshaft 7. This serves to make it unnecessary to increase the axial length of the engine 1 for disposal of the drive shaft 25, thereby keeping the engine compact. In addition, the above arrangement of the drive section A and the drive shaft 25 permits the oil pump 23 to be disposed in the deep portion 5*a* of the oil pan 5 at the front side of the engine 1. This is advantageous in that the oil pump 23 more can easily draw oil from the oil pan 5 than in the case in which the oil pump 23 is located in the flat shallow portion 5*b* of the oil pan 5.

It will be appreciated that although in the above-described embodiment, the drive section A is positioned on the first camshaft 10 between the front end face of the first cylinder head 8 of the first bank 2 and the frontmost camshaft bearing 32 nearest thereto on the first camshaft 10, it is possible to dispose the drive section A between the frontmost camshaft bearing 32 and the frontmost cam IIa for the cylinder II in case the bearing 32 is located near the front end edge face of the first cylinder head 8.

Figure 4:
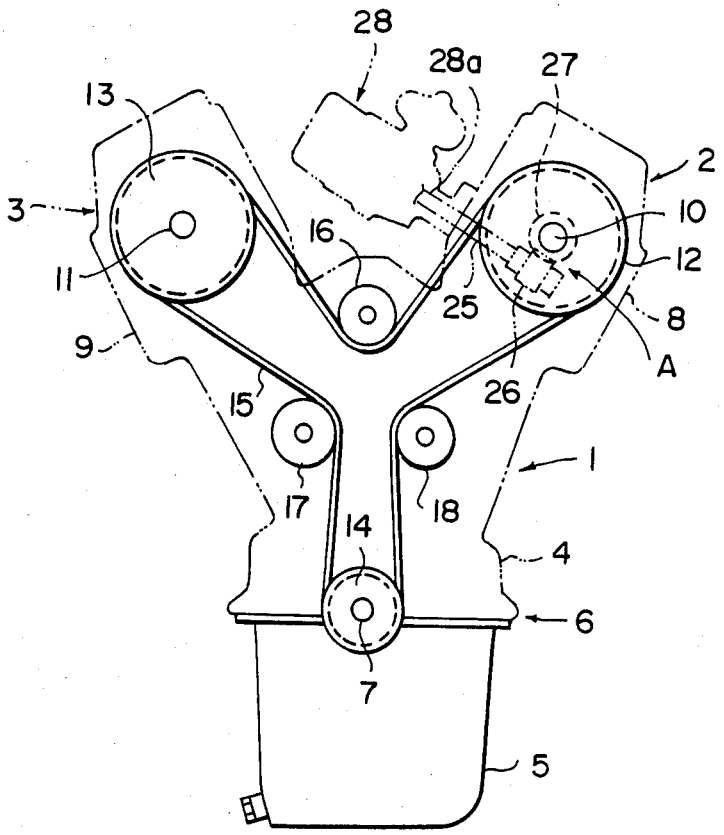
FIG. 4 is a view similar to FIG. 1 showing a second embodiment of the present invention.

FIG. 4 illustrates another embodiment of the present invention in which the engine auxiliary mechanism 28 is a distributor. As shown, the distributor 28 is situated in the space between the first and second banks 2, 3 and the drive section A for the distributor 28 is comprised of a worm gear 27 which is fixedly mounted on the camshaft 7 at a location X between the timing pulley 12 (which connects the first camshaft 10 with the crankshaft 7) and the nearest camshaft bearing 32, as in the previously described embodiment. The worm gear 27 is in mesh with a worm wheel 26 attached to one end of a drive shaft 25 which is in turn coupled at its other end with a rotation shaft 28*a* of the distributor 28, whereby the distributor 28 is driven to rotate in synchronism with the rotation of the camshaft 10. The construction and operation of this embodiment other than the above are substantially similar to those of the embodiment as shown in FIGS. 1 to 3.

Figure 5:
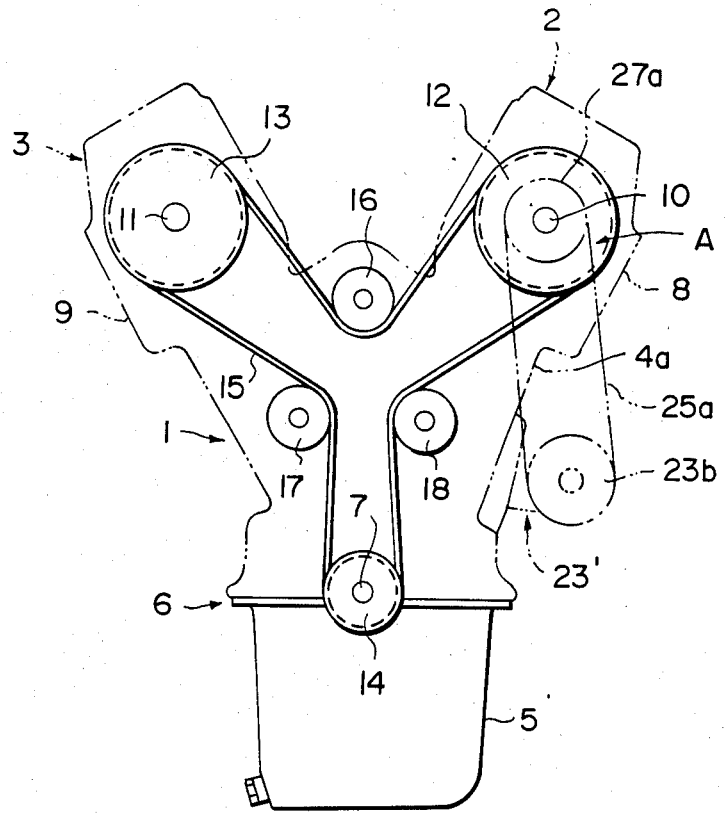
FIG. 5 is a view similar to FIG. 1 showing a third embodiment of the present invention.
Figure 6:
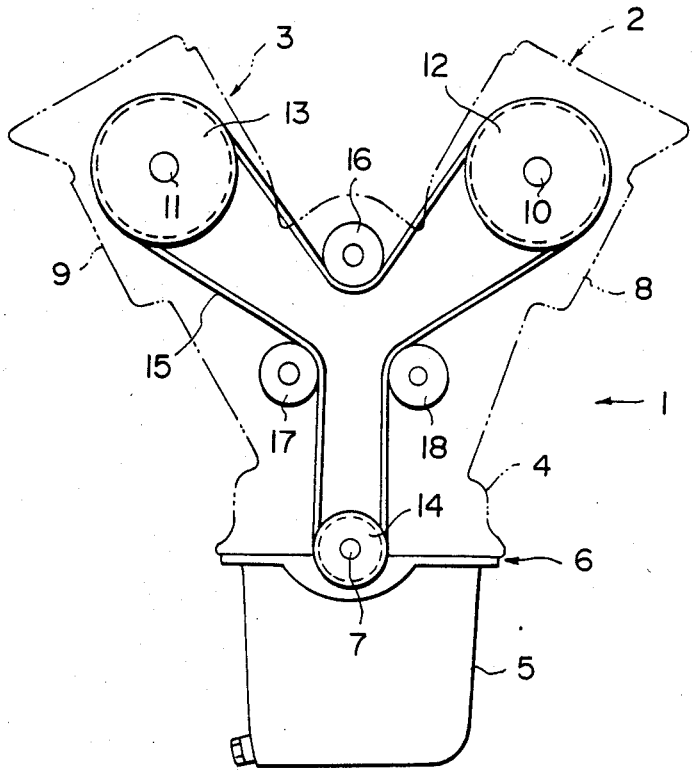
Figure 7:
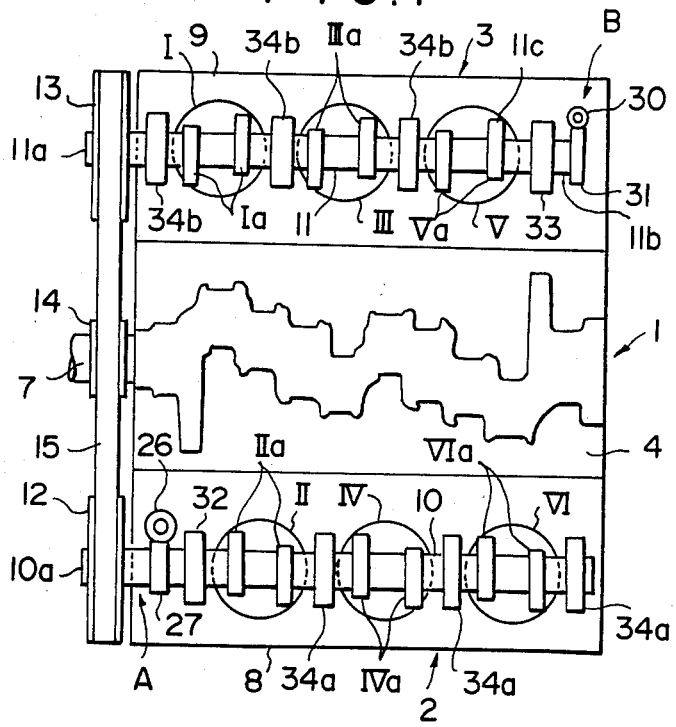

FIG. 5 illustrates a further embodiment of the invention in which the engine auxiliary mechanism 23 is a fuel injection pump for a diesel engine. The fuel injection pump 23' is disposed in and attached to a recessed portion 4*a* in the outer side wall of the cylinder block 4 at the side of the first bank 2. The drive section A for the fuel injection pump 23' comprises a timing pulley mounted on the first camshaft 10 at a location X between the timing belt pulley 12 (which connects the first camshaft 10 with the crankshaft 7) and the nearest camshaft bearing 32. The fuel injection pump 23' has a pump pulley 23*b* operatively connected with the timing pulley 27*a* by a timing belt 25*a* so that the pump 23' is operated by the rotation of the first camshaft 10. The remaining construction and operation of this embodiment are substantially the same as those of the previous embodiments.

Though not shown in the drawings, in case the engine auxiliary mechanism is a fuel pump of mechanical type, it may be constructed such that the fuel pump has a driving arm which is in camming engagement with a cam mounted on the first camshaft 10 at a location X, whereby the pump is operated by the camshaft 10 through the cam and the driving arm.

FIGS. 6 to 11 illustrate a further embodiment of the present invention in which two drive sections for engine auxiliary mechanism are provided one on the front end of one of two camshafts and the other on the back end of the other camshaft. The engine auxiliary mechanisms are an oil pump 23 disposed at the front end (the left-hand side in FIG. 7) of a first camshaft 10, and a distributor 28 disposed at the back end (the right-hand side in FIG. 7) of a second camshaft 11.

Figure 8:
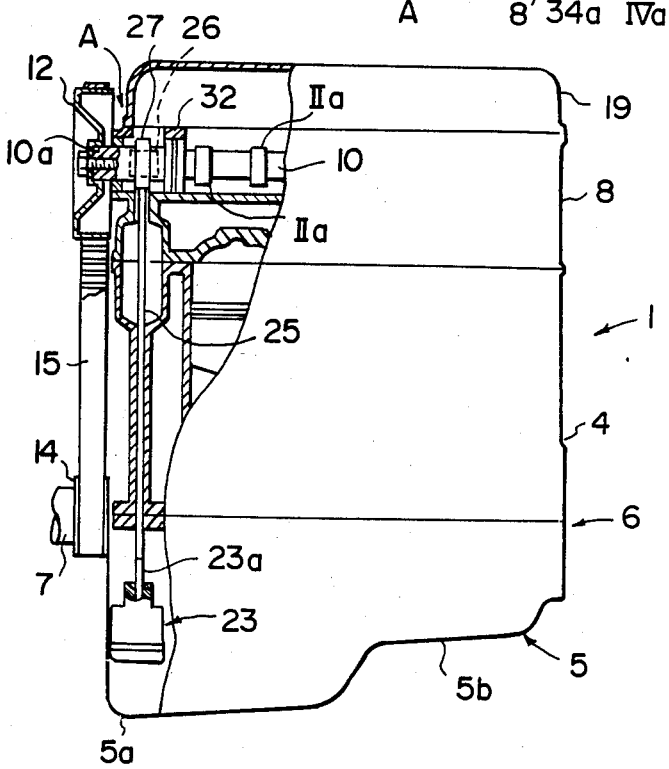
Figure 9:
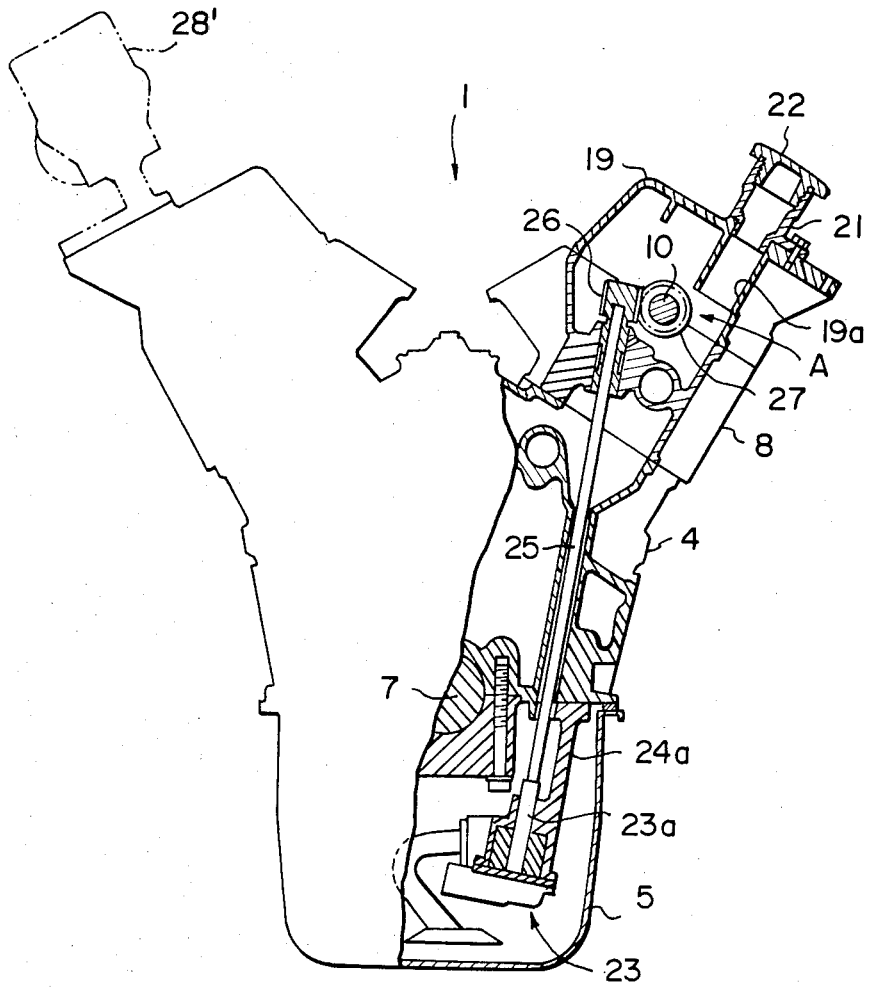
Figure 10:
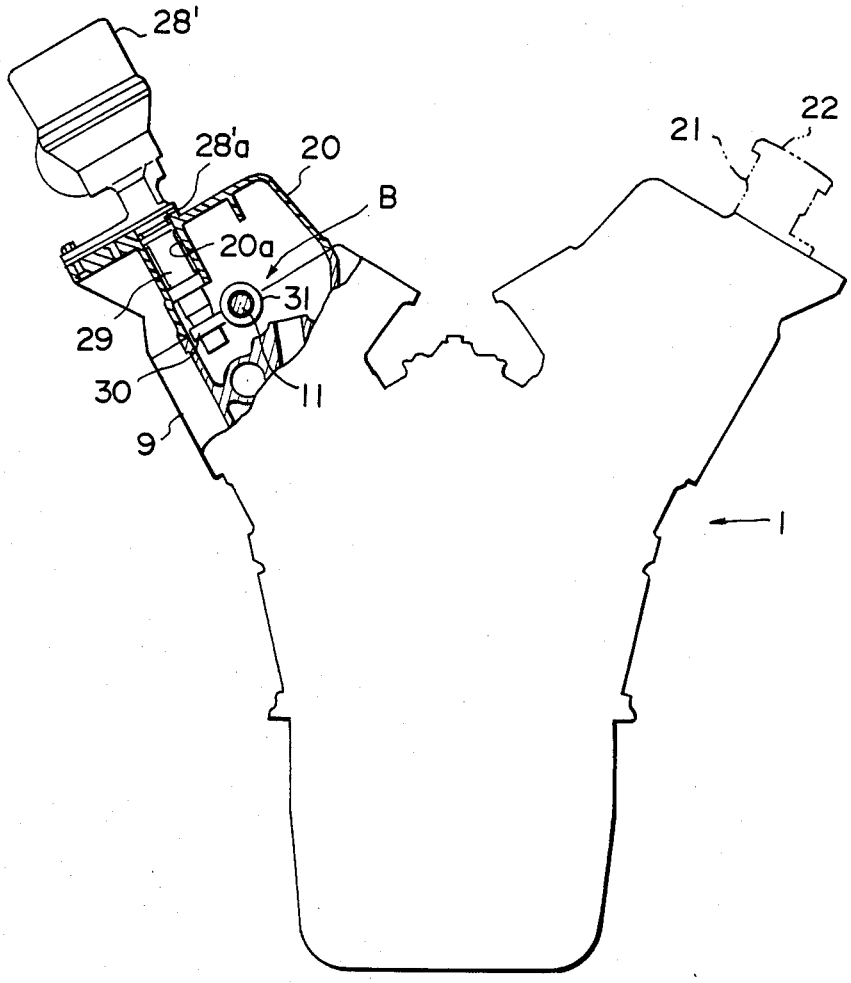

As shown in FIGS. 8 and 9, the oil pump 23, attached to the bottom surface of the cylinder block 4 through a bracket 24*a*, has a rotation shaft 23*a* which is operatively connected with the first camshaft 10 by a first drive section A which includes a worm gear 27 fixed on the first camshaft 10 between a timing pulley 12 mounted on the front end of the camshaft 10 and a frontmost camshaft bearing 32 nearest thereto for the first camshaft 10, a worm wheel 26 in meshing engagement with the worm gear 27, and a drive shaft 25 having at its one end the worm wheel 26 and being coupled at its other end with the rotation shaft 23*a*. The arrangement and operation of the oil pump 23 and the first drive section A of this embodiment are substantially the same as those of the first-mentioned embodiment illustrated in FIGS. 1 to 3.

In FIG. 9, secured to the top of a first cylinder head 8 of a first bank 2 is a first head cover 19 having an opening 19*a* formed in its top, from which opening 19*a* is outwardly projected a cylindrical member 21. The cylindrical member 21 has its outer open end closed a detachable cap 22. In this manner, an oil filler portion is formed for supplying oil to the oil pump 23.

On the other hand, the distributor 28' is mounted on a second head cover 20 secured to the top of a second cylinder head 9 of a second bank 3. Specifically, as viewed from FIGS. 10 and 11, the distributor 28' has a rotation shaft 28'*a* which is operatively connected with the second camshaft 11 by a second drive section B. The second drive section B is comprised of a drive shaft 29 coupled at its one end with the distributor rotation shaft 28'*a* and extending through an opening 20*a* in the top of the second head cover 20 into the interior thereof, a worm wheel 30 attached to the drive shaft 29 at its other end, and a worm gear 31 being in meshing engagement with the worm wheel 30 and fixed on the second camshaft 11 at a location near the back end 11*b* thereof opposite to or remote from the front end 10*a* of the first camshaft 10, at which end the worm gear 27 for the oil pump 23 is positioned. In this connection, it is to be noted that the worm gear 31, constituting a drive section for the distributor 28', is mounted on an extended portion of the second camshaft 11 between the back end face of the cylinder block 4 and the rearmost camshaft bearing 33 nearest thereto for the second camshaft 11. Thus, the distributor 28' is driven to rotate by rotation of the second camshaft 11.

With the above arrangement, the drive sections A (27 and 31) for the oil pump 23 and the distributor 28' are disposed in vacant or dead spaces of the camshafts 10, 11 which are necessarily formed forwardly of the foremost cylinder II of the first bank 2 and rearwardly of the rearmost cylinder V of the second bank 3 with a V-type overhead-camshaft engine 1. Therefore, it is not necessary to extend the overall axial length of the engine for formation of such drive sections 27, 31, thus making it possible to produce a compact engine.

It will be appreciated that although in the last-mentioned embodiment, the drive sections 27, 31 are located forwardly of the frontmost camshaft bearing 32 for the first camshaft 10 and rearwardly of the rearmost camshaft bearing 33 for the second camshaft 11, they may be arranged such that the drive section 27 is situated between the frontmost camshaft bearing 32 for the first camshaft 10 and the frontmost valve-operating cam IIa for the cylinder II in case the bearing 32 is disposed at a location near the front end face of the first cylinder head 8, whereas the drive section 31 is situated between the rearmost camshaft bearing 33 for the second camshaft 11 and the rearmost valve-operating cam Va for the cylinder V in case the bearing 33 is disposed at a location near the rear end face of the second cylinder head 9.

We claim:

1. An engine auxiliary mechanism driving device in a V-type engine comprising:

an engine crankshaft;

a pair of first and second cylinder banks arranged in V-shape and having a first cylinder head and a second cylinder head, respectively, the cylinders of the first bank being displaced from the cylinders of the second bank in the axial direction of the camshaft, said banks having oppositely disposed a first end and a second end, said displacement of said cylinder banks forming a substantial first space only between the first end of said first bank and said cylinders of said first cylinder bank and a substantial second space only between the second end of said second bank and said cylinders of said second cylinder bank;

a first camshaft provided on said first cylinder head and having a plurality of first valve-operating cams for said first cylinders;

a second camshaft provided on said second cylinder head and having a plurality of second valve-operating cams for said second cylinders;

said first and second camshafts being operatively connected at their one end with the associated end of said crankshaft for synchronized rotation therewith through a transmission means;

said first cams on said first camshaft being displaced axially from said second cams on said second camshaft in a manner such that the former are disposed axially more apart from said transmission means than the latter;

a crank case at the lower side of said cylinder banks; and an oil pump in said crank case adapted to be driven by means of said first camshaft and having a rotation shaft operatively connected with said first camshaft by a driving means;

said driving means comprising a worm gear fixedly mounted on said first camshaft at a location between said transmission means and the one of said first cams on said first camshaft nearest to said transmission means, a worm wheel in meshing engagement with said worm gear, and a drive shaft coupled at its one end with said worm wheel and at its other end with said rotation shaft of said oil pump, said drive shaft being disposed in and extending through and bounded by the first space of said first bank formed at the one end thereof adjacent to said transmission means so as to avoid any further increase of overall length of said cylinder banks to accommodate said drive shaft.

2. An engine auxiliary mechanism driving device as defined in claim 1, wherein said crank case has an oil pan formed at the lower side thereof, said oil pan being provided with a downwardly projected deep portion at the side of said transmission means, said oil pump being disposed in the deep portion of said oil pan.

3. An engine auxiliary mechanism driving device in a V-type engine comprising:

a rotatable engine crankshaft, having an axis and first and second ends;

an engine block comprising a pair of first and second cylinder banks arranged in V-shape and having a first cylinder head and a second cylinder head, respectively, cylinders of the first bank being displaced from cylinders of the second bank in the axial direction of the crankshaft, said engine block having oppositely disposed a first end and a second end, said displacement of said cylinder banks forming a substantial first apace only between the first end of said engine block and said cylinders of said first cylinder bank and a substantial second space only between the second end of said engine block and said cylinders of said second cylinder bank;

a first rotatable camshaft, having first and second ends proximate the first and second ends of said engine block, respectively, provided on said first cylinder head and having a plurality of first valve-operating cams for said first cylinders;

a second rotatable camshaft, having first and second ends proximate the first and second ends of said engine block, respectively, provided on said second cylinder head and having a plurality of second valve-operating cams for said second cylinders;

a transmission means for operatively connecting said first ends of said first and second camshafts with said first end of said crankshaft for synchronized rotation of said first and second camshafts with said crankshaft;

said first cams on said first camshaft being displaced axially, with respect to said crankshaft, from said second cams on said second camshaft in a manner such that said first cams are disposed axially, with respect to said crankshaft, further from said transmission means than said second cams;

an oil pump driveable by a driving force, said oil pump located under the first and second cylinder banks;

a drive means, mounted on said first camshaft at a location between said transmission means and the one of said first cams on said first camshaft nearest to said transmission means, for generating said driving force; and a shaft means, operatively connecting said drive means and said oil pump, for transmitting said driving force from said drive means to said oil pump, said shaft means located proximate said transmission means and between said first end of said engine block and the cylinder of said first cylinder bank located closest to said transmission means, bounded in said first space so as to avoid any further increase of overall length of said engine block to accommodate said shaft means.

4. An engine auxiliary mechanism driving device as defined in claim 3, wherein said first and second cylinder banks together define a cylinder block, an oil pan connected to the bottom of said cylinder block and said oil pump is located in said oil pan.

5. An engine auxiliary mechanism driving device as defined in claim 3, further comprising a plurality of first camshaft bearings for rotatably supporting said first camshaft, one of said first camshaft bearings being disposed between said transmission means and the one of said first cams nearest thereto, said drive means being located between said transmission means and said nearest first cam.

6. An engine auxiliary mechanism driving device as defined in claim 3, wherein said transmission means comprises a first timing pulley fixedly mounted on said first camshaft, a second timing pulley fixedly mounted on said second camshaft, a crankshaft pulley attached to said crankshaft, and a timing belt entrained around said first, second and crankshaft pulleys.

7. An engine auxiliary mechanism driving device as defined in claim 6, wherein said drive means is disposed between said first timing pulley and the one of said first cams on said first camshaft nearest to said first timing pulley.

8. An engine auxiliary mechanism driving device as defined in claim 3, 5, 6 or 7, wherein said oil pump has a rotatable shaft; said driving means comprises a worm gear fixed on said first camshaft and a worm wheel in meshing engagement with said worm gear; and said shaft means comrises a drive shaft, having two ends, coupled at its one end with said worm wheel and at its other end with said rotatable shaft of said oil pump.

9. An engine auxiliary mechanism driving device as defined in claim 3, further comprising an engine auxiliary mechanism adapted to be driven by said second camshaft and a second drive means, mounted on said second camshaft at its second end remote from said transmission means, bounded in said second space, for driving said engine auxiliary mechanism.

10. An engine auxiliary mechanism driving device as defined in claim 9, wherein said second drive means for said engine auxiliary mechanism is disposed at a location axially outwardly of the one of said second cams on said second camshaft nearest to the second end thereof.

11. An engine auxiliary mechanism driving device as defined in claim 9 or 10, wherein said engine auxiliary mechanism is a distributor.

* * * * *